United States Patent [19]

Rijkaart

[11] Patent Number: 4,686,875

[45] Date of Patent: Aug. 18, 1987

[54] SLICING APPARATUS

[76] Inventor: Lodewijk C. Rijkaart, 29, Kijftenbeltlaan, 3871 BC Hoevelaken, Netherlands

[21] Appl. No.: 798,375

[22] Filed: Nov. 15, 1985

[30] Foreign Application Priority Data

Nov. 15, 1984 [NL] Netherlands ..... 8403503

[51] Int. Cl.[4] ..... B26D 1/11

[52] U.S. Cl. ..... 83/425.2; 83/751; 83/431; 83/438

[58] Field of Search ..... 83/751, 425.2, 425.3, 83/431

[56] References Cited

U.S. PATENT DOCUMENTS

| | | | |
|---|---|---|---|
| 1,913,047 | 6/1933 | Criner | 83/751 |
| 1,948,622 | 2/1934 | Littlefield | 83/167 |
| 1,953,277 | 4/1934 | Tewes | 83/431 |
| 1,997,898 | 4/1935 | Criner | 83/438 |
| 2,147,322 | 2/1939 | Tuthill et al. | 83/361 |
| 2,479,908 | 8/1949 | Criner | 83/751 |
| 2,528,853 | 11/1950 | Brustowsky | 83/751 |

*Primary Examiner*—Donald R. Schran

*Attorney, Agent, or Firm*—Birch, Stewart, Kolasch & Birch

[57] ABSTRACT

An apparatus for cutting bread products into slices, consisting principally of: a stand (1); a supporting surface (3) for the product to be sliced, carried by the stand (1); two groups of parallel cutting blades, each group being driven with an oscillating motion transverse to the supporting surface (3), the blades of the two respective groups (5', 5'') being mounted alternately next to one another; and a pressure organ (6) which can be moved over the supporting surface (3) towards and away from the groups of blades (5), wherein the cutter blades of one group (5') include a different angle with the supporting surface (3) than the blades of the other group (5''), so that during cutting the blades of one group are ahead of the blades of the other, whereas an arrangement of this kind also has the advantage that the bread can deflect more easily, so that resistance is reduced and the cutting time is consequently shortened to approximately 3 seconds.

6 Claims, 4 Drawing Figures

SLICING APPARATUS

BACKGROUND OF THE INVENTION

Field of the Invention

The invention concerns an apparatus for cutting bread products into slices, consisting principally of: a stand; a supporting surface for the product to be sliced, carried by the stand; two groups of parallel cutting blades, each group being driven with an oscillating motion transverse to the supporting surface, the blades of the two respective groups being mounted alternately next to one another; and a pressure organ which can be moved over the supporting surface towards and away from the groups of blades.

An apparatus of the kind described in the first paragraph is chiefly used in shops, where the shop assistant slices a loaf of bread on request, before packing it. Known apparatus of this kind is equipped with relatively heavy cutter frames, which are arranged parallel next to each other so that all the blades cut into the loaf simultaneously, so that it takes a long time, from 8 to 15 seconds, to cut through the loaf.

The invention aims to so improve the apparatus of the kind described in the first paragraph, that the cutting time is considerably reduced.

The apparatus according to the invention is distinguished in that the cutter blades of one group include a different angle with the supporting surface than the blades of the other group.

As a result of this arrangement, the blades of the two groups no longer run parallel to one another, so that during cutting the blades of one group are ahead of the blades of the other. An arrangement of this kind also has the advantage that the bread can deflect more easily, so that resistance is reduced and the cutting time is consequently shortened to approximately 3 seconds.

In the preferred embodiment, the blades of one group cross those of the other group, the crossing point lying above the supporting surface. This ensures that the product to be sliced is pressed into the V-shaped opening formed by the blade groups, with the result that the product is automatically centered in the cutting blades.

In one embodiment, the end portion of each cutting blade of a group is engaged in a holder, which is connected via one or more coupling organs to a similar blade holder of the other group. This constructional solution ensures a considerable weight reduction, through the absence of the known cutting blade frames. The consequences of this weight reduction are, on the one hand, that the oscillating movement of the blade groups can be made more rapid, which has a positive effect on the cutting speed, and, on the other hand, that there is a considerable noise reduction, which is pleasant for the user. In order to reduce the number of pivot points, which are usually prone to wear, it is preferable to apply, as a coupling organ, a flexible band or strip which passes around a guidance element. This band or strip also contributes to the quiet operation and the saving of weight.

The invention further concerns an improvement to the pressure organ with which the product to be sliced is pushed towards the groups of cutting blades, and is pressed through the blades. The pressure organ according to the invention is guided along a channel section on each side of the supporting surface, and is mounted slidably in a bracket-shaped operating lever, projecting above the operating surface, which is fitted so that it is rotatable around an axis beneath the operating surface. By this means, the number of pivot points is considerably reduced, an exactly parallel guided movement of the pressing organ along the supporting surface is ensured, and the maneuverability of the slicing apparatus is improved for the user.

Further scope of applicability of the present invention will become apparaent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The above mentioned and other characteristics of the invention are further explained in the description hereinbelow and the drawings which are given by way of illustration only, and thus are not limitative of the present invention and wherein.

DESCRIPTION OF THE PREFERRED EMBODIMENTS

Figure 1:
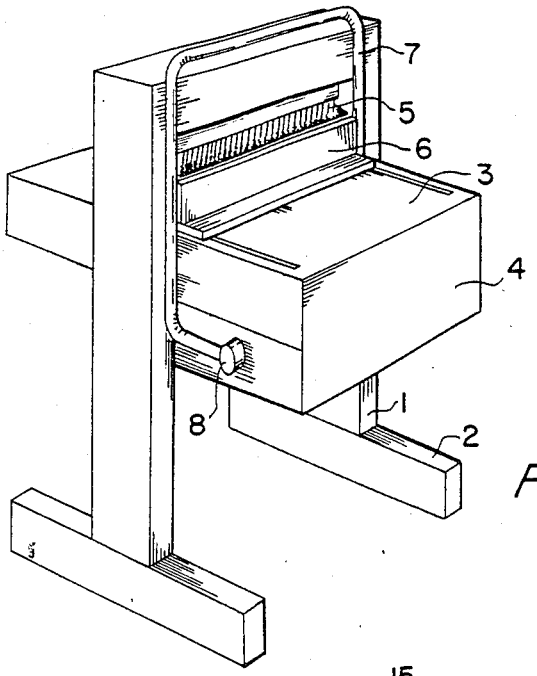
FIG. 1 shows a perspective side- and top-view of the apparatus according to the invention.

In FIG. 1, number 1 indicates the stand, which is constructed from sheet material, and has principally an inverted U-shape. The legs of the stand, at their lower ends, are widened by feet, 2, constructed from sheet material. The U-shaped stand carries a horizontal supporting surface, 3, to the underside of which a case, 4, is fitted, in which there are situated the driving means and other mechanical elements for the cutter groups 5, mounted in the stand.

Over supporting surface 3 there is a pressing organ, 6, fitted so that it can slide towards and away from cutters 5. Pressing organ 6 is operated, in a way which will be explained below, by a bracket shaped operating lever, 7, which is rotatably journalled at 8 in the casing 4.

Figure 2:
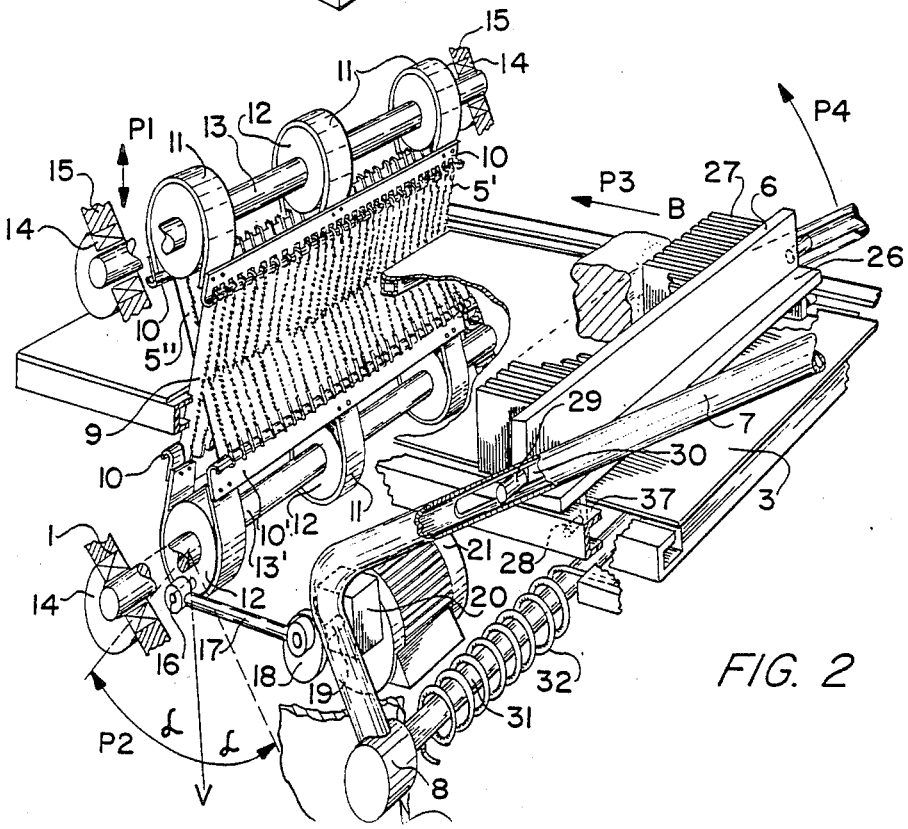
FIG. 2 shows a top view of a first embodiment, corresponding to FIG. 1 but the casing of FIG. 1 being omitted.

FIG. 2 shows an embodiment of the mechanical elements for driving the cutters 5, for the clarity of which encasing 4 and the sheeting of U-shaped stand 1 are cut away.

As is apparent from FIG. 2, the cutting blades are divided, according to the idea of the invention, into two groups, 5' and 5'', which are arranged so that each group includes a different angle with supporting surface 3. In the embodiment shown, they cross one another, the crossing point 9 lying above the supporting surface 3 (see also FIG. 4).

The upper end of each blade in a group is engaged in a holder, 10, the holders extending parallel above and below supporting surface 3, and holding the blades so that they are arranged parallel, and separated by equal intervals. The blade holder 10 of one group is connected to the blade holder 10' of the other group by means of a coupling organ, which here has the form of three flexible bands, 11. The bands are securely connected to the blade holders 10, and each is passed around a guidance element 12. The guidance element 12 shown is a disc fitted to a shaft, 13, which is rotatably supported at each end in bearings, 14. The bearings 14 are mounted in hubs, 15, which by means of an adjusting mechanism (not shown) can be adjusted up and down with respect to the U-shaped stand 1, in the direction of arrow P1. The adjusting mechanism can be embodied in any arbitrary way, for example as a threaded spindle which can be reached from outside the encasing of U-shaped stand 1, so that shaft 13 can easily be adjusted upwards or downwards by hand. It is clear that each of the discs is journalled on shaft 13, and that the shaft is non-rotatable.

At the lower end of each cutter group 5' and 5'', there is fitted a similar holder 10, 10', the lower holders also being connected by flexible coupling bands 11, each of which passes around a disc 12 on a shaft, 13'. This shaft 13' is at both ends non-displacably journalled in the U-shaped stand.

One of the discs 12, here the leftmost in FIG. 2, has a crank pin, 16, on which a connecting rod 17, engages. This connecting rod is driven via an eccentric, 18, which is fitted to the output shaft, 19, of a transission, 20, which is driven by an electric motor, 21. The last named mechanism fits into case 4 of FIG. 1. When motor 21 is energized, eccentric cam 18 is caused to rotate, whereby connecting rod 17 is brought into a back-and-forth motion, and the crank pin 16 into a rocking movement around shaft 13'. The rocking motion is indicated by arrow P2. The rocking movement is hereby such that it covers an angle on both sides of a plane V perpendicular to supporting surface 3.

Through the rocking motion of disc 12 and therefore of shaft 13', this back-and-forth rocking motion is transmitted to the flexible coupling organs 11, and thus to the blade holders 10 and 10'. By this means, both groups of cutters 5' and 5'' are brought into an up-and-down oscillating motion with respect to supporting surface 3. Obviously, the directions of motion of cutter groups 5' and 5'' are opposite.

Figure 3:
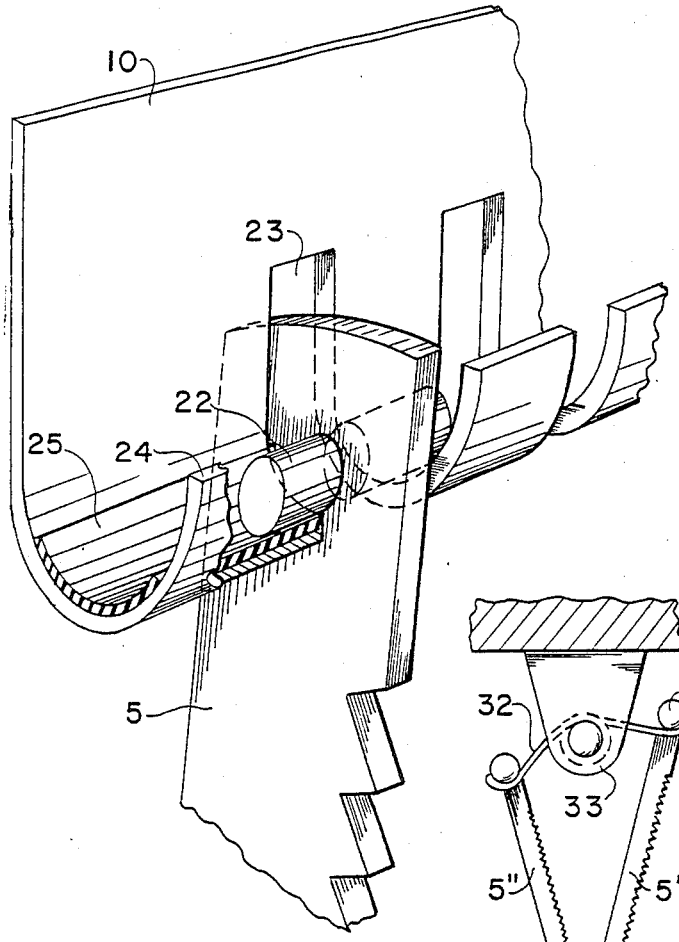
FIG. 3 shows a perspective view of a detail of the cutting blade suspension of the apparatus of FIG. 2.

FIG. 3 shows, in detail, the seating of a cutter blade in the blade holder 10. Each blade is widened at the end portion by means of a pin, 22, fitted transversely through the blade, the pin being longer than the breadth of indentation 23, which is formed in holder 10. Holder 10 takes the form of a J-section strip, the radius of curvature of the bent bottom portion of the J-section 10 being greater than the diameter of pin 22. The blade can thus be inserted simply by inserting its end portion into slot 23, to which end pin 22 can be passed over the edge, 24, of the bent portion of J-section 10, and into the bottom channel of section 10. In the bottom channel there is also situated a flexible cushion 25, upon which pin 23 rests. This construction ofers the advantage that all the blades in either group 5 or 5' can easily be placed under equal tension. This can be carried out by raising shaft 13, which is above supporting surface 3, by means of the adjustment mechanism, so that its distance to the lower shaft 13' is increased. By this means, blade holders 10 and 10' are moved away from each other, whereby the blades are stretched. Any difference in size of the blades can be taken up by the flexible cushion 25 in each holder 10.

A construction of this kind also makes it easy to replace a blade 5, after breakage, by a new blade, without it being necessary to dismantle the whole group. For this purpose, the upper shaft 13 is moved downwards in the direction of the lower shaft 13' until there is sufficient play to pass pin 22 over edge 24. This can be carried out for one blade at a time.

The apparatus is also embodied, as said, with a pressing organ 6, which is shown in further detail in FIG. 2. The pressing organ consists of a pressure plate 26, which is provided on its side facing the cutter groups with a group of parallel plates, 27, whose interval of separation corresponds to half the interval between the adjacent blades of a group, so that the plates pass between the cutter blades. The pressing organ, or the pressure plate 26, is guided in a U-shaped track, 37, of supporting table 3, to which end the underside of plate 26 is equipped with guidance pegs 28.

The pressure plate is further provided at both sides with a projecting pin, 29, which fits into slotted hole 30 of operating bracket 7. The operating bracket is attached at 8, beneath supporting surface 3, to a cross-shaft 31 journalled in casing 4, the shaft being pretensioned anti-clockwise (in FIG. 2) by means of a torsion spring 32. Torsion spring 32 thus ensures a permanent force on pressure plate 26 in the direction of the cutting blades (see arrow P3).

The assembly or dismantling of pressure plate 26 can be easily carried out by moving bracket 7 back in a direction opposite to arrow P4 so that pressure plate 26 is led to the end of guidance track 37, whereupon the plate can be taken out of the track. Pins 29 can then be removed from slotted holes 30 by inclining plate 26. Reassembly takes place in the reverse order.

The apparatus works as follows:

When handle 7 is moved back against the direction of arrow P4, space is cleared in front of the cutter groups 5, so that the user can place a loaf, B, on supporting surface 3 in front of pressing organ 26, 27. Releasing of handle 7 has the consequence that the torsion spring tends to move the handle in the direction of arrow P4, and thereby pressure plate 26,27 and loaf B in the direction of arrow P3. The loaf approaches the cutters 5 and is sliced by the blades which are moving cyclically up and down. The blades are, as stated above, driven by motor 21, which can be energized, for example, through a switch which is connected to handle 7. After the plates 27 of the pressing organ have passed completely through the cutter groups, the loaf is presented to the user on the other side of the cutter groups, in sliced form, on supporting surface 3. The user can then pack the loaf in the usual way.

Figure 4:
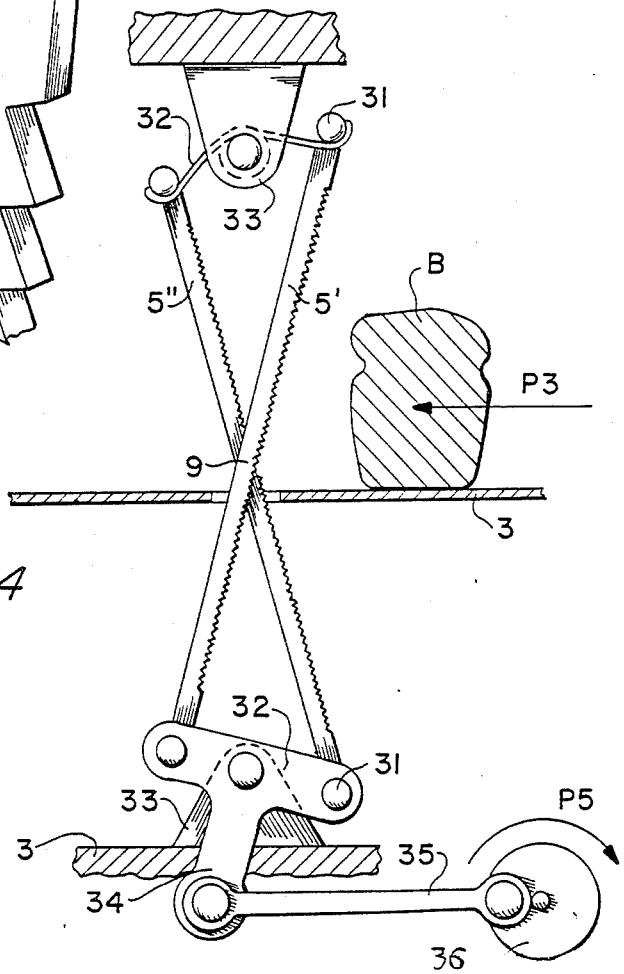
FIG. 4 shows a side view of a part of a second embodiment which can also be applied in the encasing of FIG. 1.

FIG. 4 shows an alternative embodiment of the blade suspension of the groups 5', 5''. In this embodiment, the end of each blade is secured to a shaft, 31 which is journalled at least at both ends in a rocker member, 32. The rocker member is rotatably journalled at its centre in a support, 33, fixed to the stand. The upper rocker member has the form of a leaf spring, in order to take up length differences between the groups of blades. The lower rocker member 32 is moreover made with an arm, 34, positioned transversely to the rocker member, the arm being pivoted to connecting rod 35. The connecting rod is joined rotatably to disc 36, which is driven in the direction of arrow P5 by a motor (not shown). Through this drive embodiment, the rocker members 32 are repeatedly tilted around their centres, by which means the blades also acquire a vertical oscillating movement with respect to supporting surface 3.

The operation of this embodiment is in other respects the same as that of the embodiment described with reference to FIG. 2.

Within the terms of the invention, there are obviously other coupling organs than the described bands 11 or rocker members 32. Thus, bands 11 could be replaced by a single band which extends over the full breadth of a drum, situated around shaft 13.

Furthermore, the guidance elements 12 do not have to be in the form of a disc, but could be part-discs. Weight can thus be saved. In the embodiment according to FIG. 2, there can be a relative movement between the discs 12 and the coupling organs 11 during the oscillating movement of the cutter groups. If the disc form 12 is detached, there has to be a fixed connection between coupling organ 11 and disc segment 12, the fixed connection being realized by means of arbitrary elements such as toothing, bolts, nails, etc.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

I claim:

1. Apparatus for slicing bread products comprising:

a stand with a support surface for the product to be sliced;

two groups of parallel cutting blades, each group being driven with an oscillating motion transverse to the support surface, said two groups being arranged with the blades of the two respective groups alternately next to one another, the cutting blades of one group being located at a first angle with the cutting surface, the cutting blades of the other group being located at a second angle with the cutting surface, said first and second angles being different, the one group of cutting blades crossing the other group of cutting blades at a location displaced from the support surface;

a first holder for engaging one end of the one group of cutting blades, a second holder for engaging one end of the other group of cutting blades;

at least one flexible member for connecting the first and second holders;

a guidance member for guiding the at least one flexible member, said guidance member being located intermediate the first and second holders and having the at least one flexible member partially looped therearound; and a press organ movable toward and away from the two groups of cutting blades for moving the bread products.

2. The apparatus according to claim 1, wherein said two groups of parallel cutting blades have a third and fourth holder for engaging the other end of the one group and the other group of cutting blades, respectively, said third and fourth holder being connected by another at least one flexible member, and said flexible member and said another flexible member being adjustable towards or away from each other.

3. The apparatus according to claim 1, wherein each blade has a widened end portion which is supported by either the first or second holder and said at least one flexible member is fitted between the widened end portion and the respective first and second holder.

4. The apparatus according to claim 3, wherein said first and second holders of the cutting blade ends each form a J-shaped section member.

5. The apparatus according to claim 1, wherein the press organ is guided in a U-channel on each side of the support surface, the press organ being slidably accommodated in a bracket-shaped handle extending above the support surface, the handle being secured to a rotatable shaft under the support surface.

6. Apparatus for slicing bread products comprising:

a stand with a support surface for the product to be sliced;

two groups of parallel cutting blades, each group being driven with an oscillating motion transverse to the support surface, said two groups being arranged with the blades of the two respective groups alternately next to one another, the cutting blades of one group being located at a first angle with the cutting surface, the cutting blades of the other group being located at a second angle with the cutting surface, said first and second angles being different, the one group of cutting blades crossing the other group of cutting blades at a location displaced from the support surface;

a first holder for engaging one end of the one group of cutting blades, a second holder for engaging one end of the other group of cutting blades;

at least one flexible member for connecting the first and second holders; and a guidance member for guiding the at least one flexible member, said guidance member being located intermediate the first and second holders and having the at least one flexible member partially looped therearound.

* * * * *